United States Patent [19]

Trunzo

[11] 3,934,332

[45] Jan. 27, 1976

[54] METHOD OF MAKING ELECTRICAL COILS HAVING IMPROVED STRENGTH AND OIL PERMEABILITY

[75] Inventor: Floyd F. Trunzo, Monroeville, Pa.

[73] Assignee: Westinghouse Electric Corporation, Pittsburgh, Pa.

[22] Filed: Nov. 26, 1974

[21] Appl. No.: 527,459

[52] U.S. Cl. ..... 29/605; 336/60; 336/205; 336/206; 427/14; 427/21; 427/121; 427/197

[51] Int. Cl.[2] ..... H01F 41/06

[58] Field of Search ..... 29/602, 605; 336/58, 60, 336/205, 206; 427/14, 21, 22, 32, 195, 197, 300, 121

[56] References Cited

UNITED STATES PATENTS

| | | | |
|---|---|---|---|
| 3,203,823 | 8/1965 | Grimes | 336/206 |
| 3,246,271 | 4/1966 | Ford | 336/206 |

*Primary Examiner*—Carl E. Hall
*Attorney, Agent, or Firm*—D. P. Cillo

[57] ABSTRACT

A porous, electrical insulating adhesive substrate is made, by uniformly coating a flexible, porous sheet material with adhesive resin particles having an average particle size of between about 37 to 420 microns, the adhesive coating covering from about 5 to 50 percent of the sheet material area in a non-patterned random distribution, and then heating the coated sheet material between about 85° to 250°C, forming a discontinuous 0.25 to 7 mil dry coating of discrete adhesive particles having substantially rounded cross sections bonded to the sheet material, said adhesive coating covering from about 5 to 50 percent of the sheet material area in a non-patterned random distribution; the coated sheet may then be inserted as oil permeable layer insulation between high voltage windings and low voltage windings and between layers of high and low voltage windings in a wound coil assembly, after which the assembly can be heated at a temperature and for a time effective to securely bond the winding layers together, to provide a porous, oil permeable, bonded transformer coil assembly.

10 Claims, 5 Drawing Figures

METHOD OF MAKING ELECTRICAL COILS HAVING IMPROVED STRENGTH AND OIL PERMEABILITY

BACKGROUND OF THE INVENTION

In the transformer coil art, a number of methods have been adopted for holding or anchoring the turns of an electrical coil, to resist movement when the turns are subjected to the flow of current and electromagnetic forces tending to move them out of position. A commonly practiced method is to bond the turns of the coil to the layer insulation by the use of solid resinous adhesive layers or resin solution impregnated layer insulation. This method has not been entirely satisfactory, since by filling the coil with such continuous adhesive layers or completely resin solution impregnated materials, it is rendered impervious to the penetration of oil, which is essential in providing high impulse strength in transformers.

Attempts to solve this problem have been made by Ford in U.S. Pat. No. 2,942,217 where fibers were applied to resinous, adhesive coated insulating paper, to form an oil permeable spongy mat, limiting lateral movement of contacting, tightly wound conductor layers in a transformer coil. Ford, while supplying good oil permeability to the coil, was not entirely satisfactory, since the fibrous spongy layer could allow some conductor shifting. To provide improved porous solidification of transformer coils, which will withstand large surges of power with resulting high mechanical stresses, Ford, in U.S. Pat. Nos. 3,237,136 and 3,246,271 used discontinuously patterned resin solution impregnated kraft paper as the restraint. This method however averages only about a 0.25 mil (0.006mm) to 1.5 mil (0.036mm) adhesive thickness build. This low range can be inadequate for complete wire to paper bonding, providing insufficient short circuit strength, and if large pattern coatings are overlapped oil permeability can suffer. This impregnation with resin solution saturates the paper fibers under the adhesive pattern. When the patterned paper is subject to a high humidity atmosphere, the paper surrounding the adhesive pattern can swell such that in some cases, the adhesive pattern forms a depression and is rendered ineffective to bond coils.

Other methods of coating paper have provided thicker builds of resin using dry powder application. Corbett, U.S. Pat. No. 3,503,778; and Williams, U.S. Pat. No. 3,549,403 coat paper with a dry resin powder. Corbett fuses the plastic particles applied in a dusting chamber and Williams hot roll compresses the plastic particles applied by an electrostatic coating apparatus. Papers using powders applied by the Corbett and Williams methods might bond well but would not be porous.

What is needed then, is a method of making a highly porous yet completely and uniformly bonded electrical coil, using layer insulation having a discontinuous, porous, resin adhesive coating thickness of at least 0.25 mil (0.06mm), and preferably 1 to 5 mils. The coating must be applied in a manner to allow oil permeation through a plurality of laminated layers after the resin adhesive is set.

SUMMARY OF THE INVENTION

Generally, the present invention comprises a method of making an electrical coil, or other type winding around a conductor in an electrical apparatus, the turns of which are anchored evenly throughout the coil or conductor so as to offer high resistance to displacement when subjected to magnetic stresses, and the body of which is completely permeable to dielectric fluid.

More particularly, the process involves: (1) applying solid resin particles onto a continuously moving, porous, flexible substrate; (2) heating the particles between about 85° to 250°C, to bond them to the substrate, preferably paper; (3) forming an inner insulating tube; (4) winding conductor coil turns and the resin coated substrate around the inner tube, so as to provide at least two different windings including low voltage windings and high voltage windings, the coil windings consisting, in one instance, of a plurality of radially superposed layers of helically wound wire and the layers of wire being separated by inserting the resin coated substrate to form an electrical coil structure, and (5) heating the electrical coil to form a completely oil permeable, intimately bonded assembly.

The resin coated paper is made by sifting or electrostatically applying dry resin powder, preferably modified epoxy resin particles. The powder has an average particle size of between about 37 to 420 microns. The particles are heated between about 85° to 250°C for a time effective to bond the powder to the paper but still remain in a non-set state. The powder is applied in an amount effective to provide between about 5 to 50 percent evenly disposed area coverage of the paper in a non-patterned random distribution, and the wound electrical coil is heated between about 100° to 175°C to bond the conductors to the paper and to bond adjacent paper layers. The resin coating is discontinuous, not forming an oil-impermeable solid film. The coating is at least about 0.25 mil (0.006mm) thick, preferably on both sides of the paper.

This process provides a high strength, uniformly anchored, porous coil structure, which can be used in a transformer or other type electrical device, around a magnetic core, all immersed in a dielectric liquid contained in a tank closed with a cover. Of major importance also is the fact that no volatile solvents or air pollutants are used in making the layer insulation.

BRIEF DESCRIPTION OF THE DRAWINGS

For a better understanding of the invention, reference may be made to the preferred embodiments, exemplary of the invention, shown in the accompanying drawings, in which.

DESCRIPTION OF THE PREFERRED EMBODIMENTS

Figure 1:
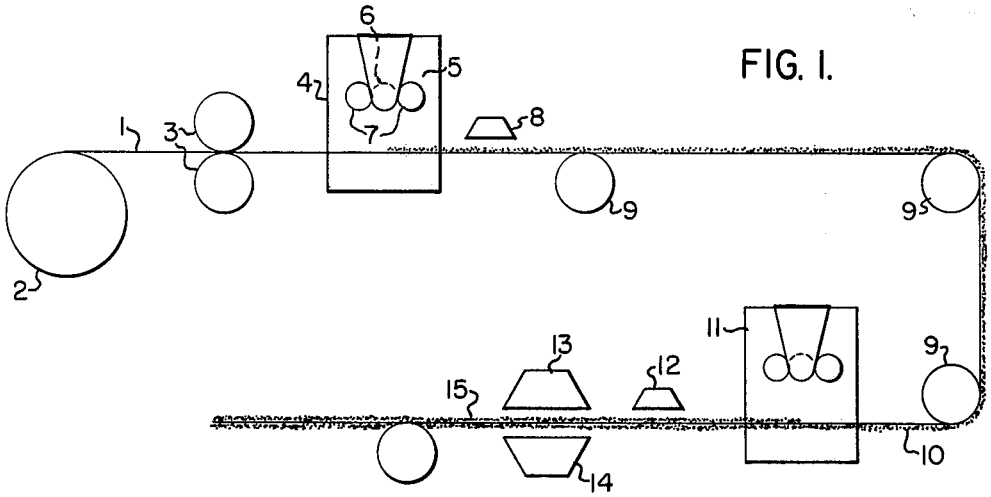
FIG. 1 shows a schematic diagram of one method of making the resin coated paper used as layer insulation in the coil of this invention.

Referring now to FIG. 1, a flexible, porous sheet or web material 1, such as cellulosic sheet, for example cotton or paper, glass cloth, polyester fabric, mica paper, asbestos paper, polyamide or polyimide or glycol ethylene terephthalate ester sheet is used as the substate. Preferably, 1 to 30 mil (0.025) to (0.75mm) crepe or kraft paper, having a moisture content between about 2 to 10 percent is used. Preferably the paper will be thermally stabilized and contain within its interstices an effective amount generally about 0.02 to 5 weight percent stabilizing agent. Suitable stabilizing agents would include melamine, triethylmelamine, triphenylmelamine, diallylmelamine, tris-tertiary butylmelamine, N-tertiary butylmelamine, dicyandiamide, polyacrylamide, succinonitrile and the like. These are usually added during paper manufacture and greatly enhance thermal stability in liquid dielectrics. The sheet material is continuously fed from pay off reel 2, through feed rollers 3, and into a resin powder applicator means 4, which may be a doctor blade applicator, vibrating sifter or preferably an electrostatic sprayer 5. The electrostatic sprayer, one type of which is described in U.S. Pat. No. 3,680,779, is fed with dry thermoplastic or thermosetting resin powder, and comprises a hopper in which is mounted chrome plated engraved or smooth roller 6 positioned adjacent to electron tubes 7. The roller 6 is driven by a motor, and as it rotates it picks up the resin powder within the hopper. Electron tubes 7 are supplied with high voltage current, and the flow of electricity creates an electrostatic field which distributes single dry powder particles evenly over the top surface of the moving sheet.

Although thermoplastic resins with reasonably high melting points i.e. between about 85° to 180°C such as nylon, polycarbonate and polysulfone resins can be used, especially in tape applications or as insulation around single conductors, they provide much less strength in the electrical coil under stress than, thermoset resins, which are preferred, especially for transformers operating at high temperatures. The thermosetting resin particularly applicable is an epoxy resin (glycidylpolyether of a dihydric phenol). Epoxy resins are well known in the art. They are generally the reaction products of bis-phenol A and epichlorhydren, and are used in conjunction with acid anhydride, amine or amide curing agent. Epoxy resins and their preparation are thoroughly discussed in Brydson, *Plastic Materials*, 1966, chapter 22, herein incorporated by reference. The epoxy resin may be modified by addition of additives such as epoxy esters of dibasic acids, polyacrylates and imidazoles to improve flexibility, cure, flow, and bonding to the supporting substrate under heat. Other suitable thermoset resins are silicon-epoxy resins and polyester resins.

These thermosetting resins must be in dry, tack-free, powder form, B-staged and remaining fusible for further processing i.e., dry, solid, but not completely cured, and capable upon further heating of being fully cured to a thermoset state. The preferred epoxy resin is a flexible resinous admixture of two different epoxy resins, an epoxy ester and a curing agent. The preferred epoxy has a melting point between about 80° to 110°C and is especially suitable for use with electrostatic guns or electrostatic spray apparatus.

The preferred epoxy is made from a diglycidyl ether of bisphenol A having an epoxy equivalent weight of about 400 to 900, and a second diglycidyl ether of bisphenol A having an epoxy equivalent weight of about 750 to 1400, with a weight ratio of the first epoxy to the second of about 1 to about 12. This is mixed with about 10 to 60 wt % of an organic placticizer or flexibilizer, such as, for example, an epoxy ester of a dibasic acid, and with any acid anhydride, amine or amide curing agent for the epoxy such as pyromellitic dianhydride, tetrahydrophlhalic anhydride, bonzophenone tetracarboxylic dianhydride, ethylene diamine, diethylene triamine, triethylene tetramine, dimethylamine propylamine, benzyl dimethylamine, methylene dianiline and dicyandiamide. A polyacrylate flow agent, and an accelerator, such as 2-methyl imidazoledicyandiamide or a hydrazide are also used.

The resin powder must have an average particle size of between about 37 to 420 microns (U.S. sieve size between 400 to 40 mesh). Within this particle range, the final resin adhesive thickness after final bonding will be within the range of about 0.25 mil (0.006mm) to 7 mils (0.16mm), and preferably from about 1.0 mil to 5 mils. Particles over about 420 microns provide thick builds of resin, which when later bonded, flow appreciably and do not provide adequate oil permeability for transformer coil applications. Such thick builds would also require longer heating times and provide bonded coatings over 7 mils (0.12mm) thick, thereby increasing the dimensions of the transformer coil. Particles under about 37 microns would tend to provide a very fine deposit which would appreciably reduce bond strength of the coated paper.

The area coverage of the moving paper sheet is critical, and the powder must be applied in an amount effective to provide between about 5 to 50 percent fairly uniform area coverage of the paper in a non-patterned random distribution. Area coverage below about 5 percent will appreciably reduce bond strength of the coated paper. Area coverage above 50 percent will result in an excellent bond, but due to melt flow during later bonding, will tend to produce a continuous oil impermeable film on the paper. The preferred area coverage is between about 15 to 30 percent. Area coverage can be measured by photographing coated paper samples at 20 to 100X magnification and comparing the photograph with available standard area coverage charts.

The powder coated cellulosic sheet, having a process speed of between about 10 to 120 ft./min (3.3 to 39.6 m/min), preferably 15 to 70 ft./min (4.95 to 23.1 m/min), passes under an initial heating means such as infrared radiant heater 8, providing a heating temperature of between about 85° to 185°C, but preferably 145° to 180°C, i.e., the temperature at the top side paper level. This provides a particle temperature of about 95° to 105°C. Of course, the particle temperature will be substantially lower than the heater temperature. The heater temperature must be adjusted to the web speed in a manner effective to provide a non-continuous coating. For example, if the web speed is 120 ft/min, a heating temperature of 185°C may be appropriate but if the web speed is 10 ft/min, a heating temperature of 85° to 100°C may be adequate. The combination temperature and web speed of 85° to 100°C may be adequate. The combination temperature and web speed must not produce a completely melted non-porous resinous layer on the paper. Heater 8, installed after the first powder applicator means bonds the powder particles to the paper so that the powder does not drop off the paper as the paper moves downward and returns under heat lamps later in the process. It is not essential to heat the powder when an electrostatic sprayer is used, since the powder remains on the paper without application of heat due to the electrostatic attraction of the powder to the paper.

The powder coated cellulosic sheet continues over supporting idling rollers 9, which are disposed in a manner effective to reverse the sheet sides i.e. the coated side proceeds down and around the rollers to become the bottom side of the sheet at point 10. The powder coated cellulosic sheet is then fed into resin powder applicator means 11 which is preferably an electrostatic sprayer. Again the dry resin particles are evenly distributed over the top surface of the moving sheet in a non-patterned random distribution. The resin powder must have an average particle size between about 37 to 420 microns. The area coverage of the moving paper is critical and the powder must be applied in an amount effective to provide between about 5 to 50 percent, but preferably 15 to 30 percent area coverage of the paper. Preferably both sides will have the same percent area coverage and average particle size.

The powder coated cellulosic sheet passes under initial heating means such as infrared heater 12, providing a heating temperature of between about 85° to 185°C but preferably between about 145° to 180°C, at the top side paper level. This heating step is optional in the process. The powder coated cellulosic sheet is then passed through final heating means such as infrared radiant heaters 13 and 14. When initial heaters 8 and 12 have been used, heaters 13 and 14 should provide a heating temperature of between about 145° to 250°C at the top and bottom side paper levels. When initial heaters have not been used, heaters 13 and 14 should provide a heating temperature i.e. the temperature at the paper surface of between about 190° to 250°C at the top and bottom side paper levels. Of course, other type heating means such as an enclosed gas or electric oven not having appreciable air currents could be used.

In any case, the powder coated paper, as it exits the heaters at point 15, should have at least a 0.25 mil (0.006mm) layer of resin adhesive particles on each side of the cellulosic sheet. These layers should not be over about 7 mils thick. The coating must be discontinuous on both sides with an adhesive particle projection point area coverage of between about 5 to 50 percent of the paper. When a thermoset resin is used it will be in a B-stage, fusible but dry to the touch. The heating temperature must be such that the coating is not melted to the extent that a solid film or nearly solid film is produced. The cellulosic sheet with bonded powder coating may then be wound onto a takeup reel. Of course the resin coating composition and state of cure must be such that the paper will not block or stick on the takeup reel in a dry or humid atmosphere.

Figure 2:
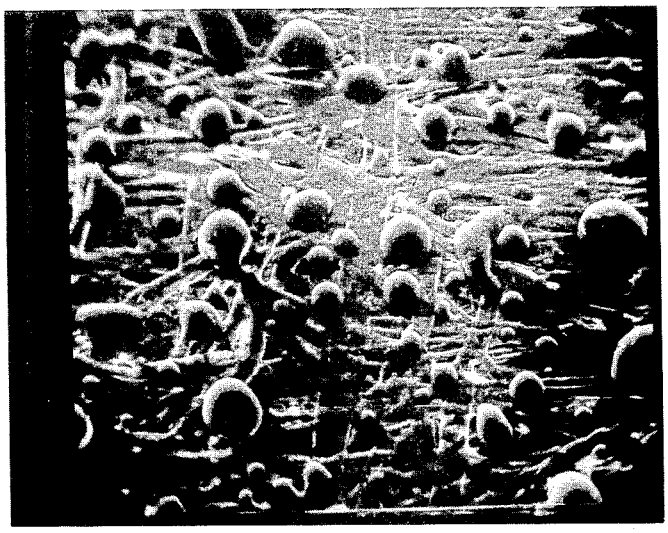
FIG. 2 shows a 100× electron micrograph of resin powder particles bonded to the paper substrate in accordance with the method of this invention.
Figure 3:
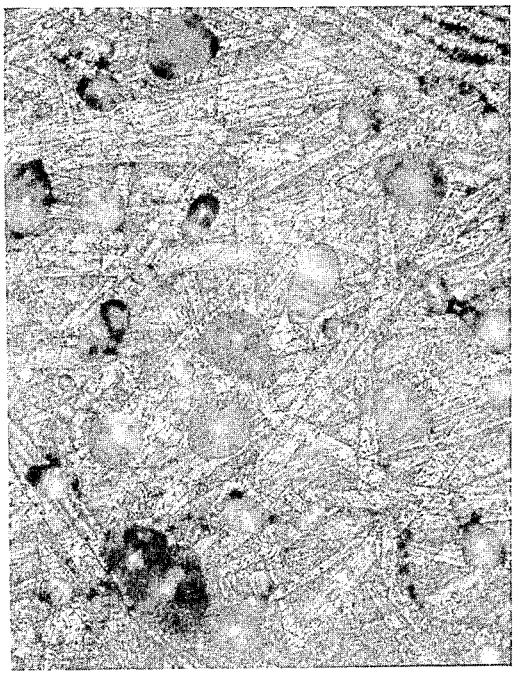
FIG. 3 shows a 100× photograph of resin powder particles bonded to the paper substrate, in accordance with the method of this invention.

FIGS. 2 and 3 show a typical powder coated sheet at 100X magnification, under an electron microscope and under a regular microscope, as it would appear at point 15 after heating. As can be seen, the discrete particles of resin having substantially rounded cross sections are still in smoothed, substantially particulate form, and are not in any pattern but are spaced randomly over the paper in about a 25 percent area coverage. Initially the particles are of irregular shape, but after heating according to the method of this invention the particles smooth out and flow a small amount to form the tear shaped particulate shape. The particles are not melted to the extent that substantial flow has caused a fused film to be formed. As can be seen, the powder coated sheet is highly proous, yet provides a substantial area of resin adhesive projection points evidencing a limited amount of flow on its surface.

To achieve the type porosity of the coated paper, and adequate bonding of the particles to the paper required for transformer layer insulation, the web speed of the paper through the heaters must be adjusted within the 10 to 120 ft./min limit, so that the resin particles are neither undercured, not bonding to the paper, nor thermoset. At web speeds above about 75 ft./min, banks of high temperature heaters, or an oven would probably be required to provide adequate adhesive powder bonding.

When thermoset resins are used, the particles, as they exit from the heaters must be in the non-set state, so that when the coated paper is applied between the paper and wire coil layers in a transformer, the resin particles, contacting the wire coils or resin particles on an adjacent particle coated paper layer, can be heated to a final thermoset state. Thermosetting securely bonds the paper to paper layers or paper to coil layers together, preventing any movement due to electrical stresses, while still maintaining an oil permeable, discontinuous particulate layer of between about 5 to 50 percent area coverage on the paper. Little or no uncoated paper area is lost in the thermosetting or final bonding of the coil. The resins used must of course be compatible with transformer oil if the tape is to be used in tranformer oils and must not be soluble or degraded to any appreciable extent in hot transformer oil.

The particle coated paper is then wound on a mandrel to form a central inner insulating tube of a plurality of layers. Low voltage windings are then wound on the inner tube, the winding being of a plurality of copper or aluminum flat foil layers or radially superposed layers of helically wound round or rectangular copper or aluminum wire, insulated with, for example, a resinous enamel such as polyvinyl formal, epoxy, polyimide, polyamide, polyamide-imide, polyester, polyesterimide, acrylic, polyurethane or any other suitable magnet wire enamel. The size of the conductor employed will depend on the specification of the coil and the duties which it has to perform. The particle coated paper if simultaneously wound with the low voltage windings, providing layer insulation between adjacent turns of the winding, each layer of wire being separated from each other by the resin particle coated paper.

Figure 4:
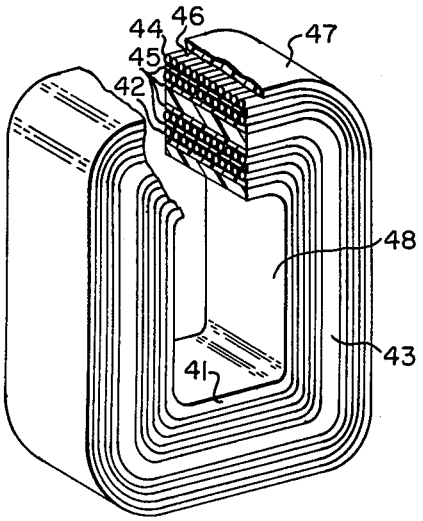
FIG. 4 is a sectional three dimensional view of the windings of a transformer made in accordance with the method of this invention.

In a similar fashion, a high voltage winding is wound simultaneously with particle coated paper, providing layer insulation between adjacent turns of the winding, each layer of wire being separated from each other by the resin coated paper. After the inner low voltage windings and high voltage windings are completed an outer low voltage winding may be added. A spacer, consisting of a plurality of layers of particle coated paper may be wound between the low and high voltage windings as shown in FIG. 4, where the inner insulating tube is shown as 41, one of the low voltage windings is shown as 42 and the spacer is shown as 43.

In the case where magnet wire is used as the windings, the individual wires are insulated and each layer separated by layer insulation. This is also the case with uninsulated flat metal foil used as the coil windings.

Where flat insulated metal foil is used, the layer insulation need not be used to separate each adjacent foil winding, and it is to be understood in this case that a plurality of up to four foils will be considered as one winding.

The high and low voltage windings may in addition be further separated by duct forming spacers, not shown in the drawing, such as fiber or wooden strips, corrugated fibrous sheet or the like, so that oil can actually flow between the various sets of windings. The number of duct sections will vary depending on cooling requirements at the particular transformer rating. In FIG. 4, one of the high voltage windings is shown as 44 and the layers of interdisposed layer insulation of resin particle ccoated paper are shown as 45. The plurality of radially superposed layers of helically wound wire comprising one of the windings is shown as 46 with outer layer of resin coated paper as 47. A core formed of any suitable magnetic material is placed in space 48, in the center of the electrical coil.

The wound coil assembly can then be placed in an oven or other suitable heating means at a temperature and for a time effective to securely bond the whole assembly by melting the resin to a semifluid which will not flow appreciably if thermoplastic powder was used, or thermosetting the resin if the powder used was a preferred thermoset powder. The transformer coil is then colled and the adhesive hardens and bonds the various layers of the transformer coil together to form a solid, uniformly bonded, oil permeable coherent unit. This step must not substantially alter the 5 to 50 percent powder coverage of the paper. The curing or thermoset temperatue can vary from about 100° to 175°C for about 1 minute to 6 hours, preferably 30 to 180 minutes.

It is critical in this final bonding step that the bonded resin particles remain in substantially the same projection point form, with substantially the same area coverage of the paper as before curing or thermosetting. The resin adhesive particles will adhere to each other, the paper and the wire, and bond the paper to the insulated magnet wire layers and adjacent paper layers and then set, preventing almost any movement of the wire and paper layers under stress, particularly when thermoset resin is used. The wound coil assembly is then placed in its transformer container where a vacuum oil impregnation process takes place. A liquid hydrocarbon base insulating oil, such as cable or transformer oil, is employed preferably in heated and deaerated form as the impregnant.

One suitable oil, for example, would contain about 10 weight percent aromatics, have a viscosity index of about 77 and a specific gravity at 16°C of about 0.88 to 0.90. Generally, mineral oils obtained from the heavy-distillates fraction of crude petroleum are the most widely used insulating liquids. The unsaturated constituents which would result in poor oxidation stability are removed from the distillate. Care must be taken to prevent removal of all the aromatic hydrocarbon content. This is important for its contribution to oxidation resistance and the ability of the oil to absorb hydrogen which might be liberated by electric discharges in the oil. Small amounts of inhibitors, such as di-tert-butyl-p-cresol are added to improve oxidation stability. These oils have low dielectric constants, about 2–2,5 and low power factors, less than about 0.1 percent.

A vacuum of about 2mm of Hg is drawn on the tank containing the wound coil assembly and the oil is introduced. The pressure of 2mm is held from 4 to 15 minutes depending on the size of the coil until all evolution from the coil assembly ceases. At this time the vacuum is generally removed and the pressure in the tank restored to atmospheric pressure. Curing or thermosetting of the resin particles can be accomplished at this point in the process, if the entire transformer assembly were put in an oven at a temperature range between about 100° to 175°C, and if a suitable oil is used that will not be degraded. The heating would be for about 1 minute to 6 hours, preferably 30 to 180 minutes. Of course the preferred method is to bond the coil prior to oil impregnation, since not only the oil but the transformer components would have to withstand the heat if the particles were thermoset in the transformer. Also bonding before impregnation would remove most of the moisture from the coil allowing better oil permeation.

Figure 5:
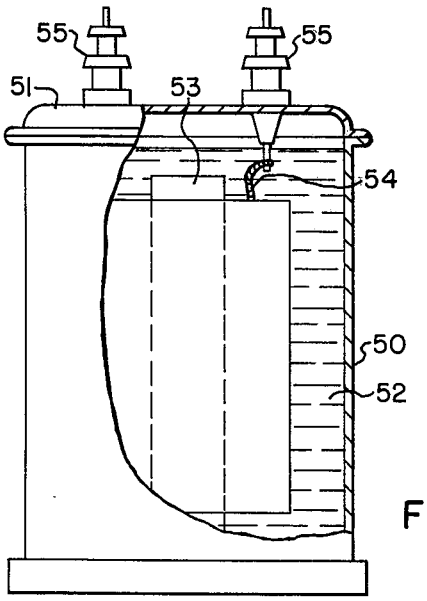
FIG. 5 shows, in side elevation, a transformer with a portion cut away to show a coil embodying the invention as it is mounted and immersed in oil.

Referring now to FIG. 5, the coil structure of FIG. 4 is operatively assembled in a transformer which comprises a tank 50, closed by a cover 51 and containing dielectric liquid 52 such as mineral oil or the like. In the transformer the coil structure encircles magnetic core 53 and the high and low voltage leads, one of which is shown as 54 are respectively connected to corresponding bushings 55 mounted on the cover.

While the method of this invention is primarily drawn to making oil cooled distribution transformers, where the resin adhesive particle coated paper is used as the layer insulation, other uses are possible. The coated paper could be engaged as layer insulation for a conductor-insulation combination in a bonded electrical apparatus. The particle coated paper, coated only on one side could also be used, for example, as an outer tape wrapper of a conductor configuration in various types of electrical apparatus or to bond 0.1 to 1.3 million volt-ampere pancake coils for large power transformers.

EXAMPLE 1

Ten mil (0.25mm) thick, 6 inch wide kraft paper, having a moisture content of about 5 to 10 percent and containing about 1 to 3 wt% thermal stabilizing agent was coated to a thickness of about 4 mils (0.1mm) total, 2 mils on each side of the paper, with modified bisphenol A epoxy resin powder. The paper was coated using an apparatus substantially as shown in FIG. 1 of the drawings, comprising a paper roll, two electrostatic coating apparatus (manufactured by Oxy-Dry Sprayer Corporation) four infrared heaters, and a series of rolls to feed the paper and reverse its top side after the first dry powder application.

The paper was fed at a web speed of about 11 ft./min (3.6m/min) between a 4 inch diameter top rubber roller and a 4 inch diameter bottom stainless steel roller into a Series 500 Oxy-Dry Sprayer apparatus placed in a plexiglass enclosure. The sprayer hopper was loaded with modified epoxy resin powder having an average particle size of 74 microns (200 mesh).

The resin was a modified epoxy resin having a melting point of about 85° to 100°C. The resin was in dry powder form and capable of being heated to a thermoset state. The resin consisted of an admixture of two separate epoxies. One epoxy was a diglycidyl ether of bisphenol A having an epoxy equivalent weight of about 400 to 900. The other was a diglycidyl ether of bisphenol A having an epoxy equivalent weight of about 750 to 1400. These epoxy resins were modified by addition of about 40 wt% of an epoxy ester of a dibasic acid flexibilizer, such as COOH—$C_x$-$H_y$—COOH, where $y = 2x$, and $x$ = about 30 to 40. This composition also contained small effective amounts of polyacrylate flow agents, dicyaniamide curing agent and imidazole accelerator.

The paper was passed under the sprayer, which was positioned about 2 inches above the paper top surface, and dry powdered epoxy resin particles, having an irregular granular configuration, were uniformly dispersed over the top surface, of the paper in a non-patterned random distribution. The area coverage of the paper was fairly uniform and between about 15 to 25 percent. The powder-coated paper was then passed under an 1100 watt infrared radiant heater positioned 1½ inches above the paper surface, and providing a heating temperature under the heater and at the top paper surface of 150° to 175°C. This initial heater at the low web speed slightly bonded the powder particles to the paper, caused a minimal amount of resin flow and just started to round off the irregular configuration of the resin particles.

The powder-coated paper was fed over two 2 inch diameter idler rollers on a horizontal plane, then vertically down to a third roller and around the third roller to a horizontal plane; the powder-coated paper surface being reversed so that it was the bottom surface of the paper, as shown in FIG. 1 of the drawings. The paper, maintained at a web speed of 11 ft./min was then fed into the second Oxy-Dry Sprayer apparatus placed in a plexiglass enclosure, containing the same modified epoxy resin described above, and positioned 2 inches above the continuously moving paper. Dry powdered epoxy resin particles, having an irregular granular configuration, were uniformly dispersed over the surface of the paper in a non-patterned random distribution. The area coverage of the paper was again between about 15 to 25 percent. The powder coated paper was then passed under another 1100 watt infrared heater, positioned about 1½ inches above the paper surface, and providing a temperature at the top paper surface of about 150° to 175°C.

The paper, with bonded, slightly smoothed resin adhesive particles bonded on both sides, was then passed through a heating section comprising one 1600 watt infrared radiant heater disposed 2 inches above and one below the paper surface. These heaters provided a heating temperature between the heaters and at the top and bottom paper surface of 150° to 200°C. This combination web speed and heating temperature provided a porous coated tape with particles bonded to the paper but not thermoset. The particles were not appreciably melted and did not form an oil impermeable layer. The particles had a rounded cross section and retained an area of paper coverage of about 18 to 20 percent. The paper was then wound onto a take up reel and did not stick or block. This provided a porous resin coating on a dry unsaturated paper substrate with little resin penetration into the paper.

This resin coated paper was incorporated into transformer coils by winding insulated copper electrical conductors into turns around an inner insulating tube, made of a plurality of the coated paper turns, to form a low voltage winding, a high voltage winding and an outer low voltage winding. The resin coated paper was inserted as the electrically insulating material between the low and high voltage windings and between each layer of the low voltage winding and the high voltage winding. This formed a 25KVA transformer coil similar to that shown in FIG. 4 of the drawings.

After the coil was wound it was heated at 135°C, for about 4 hours, to advance the modified epoxy resin adhesive to the thermoset state and permanently bond the layer windings into a solid coil leaving interstices for complete oil penetration. The transformer coil was then placed in transformer oil. The oil was a refined mineral oil and contained no additives free moisture, inorganic acid, alkali or free sulfur. It had a dielectric strength (0.1 inch gap) of 30KV min, a power factor (60 cycle, 25°C) of 0.05% max, a viscosity (SSU, 37.8°C) of 62 sec. and a specific gravity at 15.5°C of 0.898.

While the coil was in oil in the transformer assembly at room temperature, ionization and temperature rise tests were run. In the ionization test, the coil was connected to a variable high power voltage source and voltage increased until ionization was detected. The results showed that ionization commensed at a high voltage level and the paper barrier layers were thoroughly saturated with the oil, and provided an excellent transformer insulation system. In the temperature rise test, voltage was impressed across the coil while still immersed in the oil, and the temperature increased only a small amount and well within a level acceptable to operation of the transformer. In this test 7200 volts was impressed across the high voltage windings and 240 volts across the low voltage windings. At a 100 percent load of 3 amps, the oil temperature increased from 25°C to 47.5°C. At 180 percent load the oil temperature increased to 98°C.

The oil saturated transformer coil was then taken out of the oil and subjected to mechanical loading tests designed to produce telescoping of the coil layers. In this test metal mandrels were inserted between two layers of the low voltage windings and high voltage windings. A force of about 6700 pounds was required to displace the inner low coils and a force of about 6090 pounds, applied by a press onto the stationary mounted coil, was required to displace the middle high coils. This is a force about 10 times more than that required in prior art low voltage coils using dried 0.25 mil thick amine cured 60 percent resin patterned biphenol A epoxy solution coated on one side of 10 mil kraft paper as the low voltage layer insulation. It is also about 12 percent better than the telescoping force for 0.25 mil thick epoxy solution coated on both sides of 10 mil kraft paper as high voltage insulation; the values for the prior art coils being about 680 pounds (low) and 5230 pounds (high layer insulation). Additionally, it was determined that failure occurred by tearing and delamination of the paper rather than by inter-laminar slippage as with the patterned varnish-coated paper.

This method of coating the restraint provided excellent room temperature and much improved elevated temperature bond strength, excellent oil permeability, excellent resin retention on the paper surface without oil degradation at high temperatures, and used no volatile solvents or air pollutants. This adhesive coated substrate would also lend itself to bonding oil duct sticks to the paper, and could allow an automated method to replace the present messy, time-consuming hand operation, where a varnish is painted on each duct stick. The coated restraints can be used to bond pancake coils for large power transformers when used as an outer bonding conductor wrapper.

EXAMPLE 2

A variety of 10 mil thick, six inch wide kraft paper samples, having a moisture content of about 5–10 percent were coated on both sides of the paper with the resin particles described in Example 1 using the same techniques, paper speed and heater temperatures as in Example 1. The tensile shear strengths of one inch square samples were tested. The test specimen construction consisted of four 1 inch squares of coated paper stacked and sandwiched between the ends of two 10 mil thick aluminum strips 1 inch wide and 5 inches long. Test pieces were bonded under pressure of 2 lb/sq. in. and cured at 137°C.

Tensile shear bond values were obtained at 25°C and 150°C by using a laboratory oven in which multiple samples were mounted. One end of each sample was fixed to the base of the oven and the other to a damping device with a rod extending through the top of the oven. A spring balance was attached to a loop on the outside end of the rod and to a flexible stranded cable fixed to a horizontal rod mounted on a frame work above the oven. An arm at the end of the horizontal rod to which the cable was attached was used to rotate the rod and create a vertical force in the sample to be tested. The force of failure was read on the graduated spring balance. The test results are set out below:

| Sample | Build (mils) | Area Coverage (%particles) | Tensile Shear Strength (lb/sq.in) 25°C | 150°C |
|---|---|---|---|---|
| 2a | 2.5 | 18 | — | 28 to 58 |
| 2b | 3.0 | 15–18 | 58–60 | 33 to 60 |
| 2c | 4.0 | 20 | 60 | 18 to 38 |
| 2d | 4.5 | 20 | 60 | 31 to 60 |

Accelerated oil compatibility thermal aging tests were run on the various components that would be used in a transformer. Enameled rectangular wire and round wire, kraft paper, transformer iron, and a sandwich construction of layers of 1 × 4 inch x 0.0035 inch adhesive coated kraft paper made as described above, were placed in a 5 inch dia stainless steel tank, which was then filled with transformer oil. A vacuum of 28 inches of $H_2O$ was pulled on the system for 1 hr. after which the tank was sealed and aged 28 days 5 150°C. The amount of each component used in the test was approximately proportional to that used in a typical oil filled distribution transformer. After removal of the components the oil was tested for color, dielectric strength and power factor versus unused oil. The oil compatibility with the components was excellent. The measurements showed that the used oil was still an excellent insulator and not affected by the bonding resin on the coated paper. This example further showed excellent tensile shear strength retention at elevated temperatures similar to those found in a short circuit transformer environment.

EXAMPLE 3

One side of a 10 mil thick one inch wide kraft paper sample, having a moisture content of about 5–10 percent was hand sift coated with about 3 to 5 mils of the modified epoxy resin particles described in Example 1. The coated kraft paper was placed in an oven at a temperature of about 135°C for about 45 seconds to bond the modified epoxy powder to the paper without thermosetting it. The one inch wide coated paper was wrapped two laps around one end of two 1×⅜×55 inch copper bars. These copper bars with wrapped coated paper were then bonded to the ends of a third copper bar with an overlapping 1 square inch area at 2 lb/sq. in. and cured at 135°C.

Tensile shear bond valves were obtained using the procedure outlined in Example 2, where the third copper strip was anchored to the furnace and vertical force applied simultaneously to each end of the cantilevered copper bars. Similarly, tensile shear bond valves using the same procedure were obtained using coated paper having dried 0.25 mil thick amine cured 60 percent resin patterned bisphenol A epoxy solution coated 10 mil kraft paper as the wrapping around the copper strips. The test results are set out below:

| Sample | Build (mils) | % Area Coverage Of Resin | Tensile Shear Strength (lb/sq. in) 25°C | 150°C |
|---|---|---|---|---|
| dry epoxy powder coated paper | 2–5 | 18–20 | 27.5 | 20.6 |
| dried epoxy solution coated paper | 0.25 | 60 | 26.6 | 9.1 |

Failures in the dried epoxy solution coated sample were through adhesion and cohesion. Failures in the dry epoxy powder coated sample were on the paper side of the test strips due to paper tearing. This example shows the improved coating thickness and high temperature tensile shear strength of layer insulation made in accordance with this invention. Also the dry epoxy coated paper was not affected by moisture.

I claim:

1. A method of making an oil permeable, bonded transformer comprising the steps of:

A. continuously, uniformly coating both sides of a flexible, porous sheet material having a thickness of between about 1 to 30 mils with dry adhesive resin particles having an average particle size of between about 37 to 420 microns, said coating covering from about 5 to 50 percent of the sheet material area in a non-patterned random distribution;

B. heating the coated sheet material between about 85° to 250°C for an effective period of time, forming a discontinuous 0.25 to 7 mil dry coating of discrete adhesive particles having substantially rounded cross sections bonded to each side of the sheet material, said adhesive coating covering from about 5 to 50 percent of the sheet material area in a non-patterned random distribution, to provide a porous, oil permeable resin particle coated layer insulation;

C. winding electrical conductors into turns, to form at least two different windings including a high voltage winding and a low voltage winding and inserting the porous, oil permeable, resin particle coated layer insulation between the high voltage winding and low voltage winding and between layers of the high voltage winding and the low voltage winding, to provide a wound coil assembly;

D. heating the wound coil assembly at a temperature and for a time effective to securely bond the winding layers together, while still providing an adhesive covering of the layer insulation of between about 5 to 50 percent, to provide a porous, oil permeable bonded coil assembly; and E. impregnating the wound, bonded coil assembly with an insulating oil comprising a hydrocarbon liquid.

2. The method of claim 1, wherein the wound coil assembly of step (C) is first placed in a transformer container, vacuum impregnated with an insulating oil comprising a hydrocarbon liquid and then the transformer container heated at a temperature and for a time effective to securely bond the winding layers together, while still providing an adhesive covering of the layer insulation of between about 5 to 50 percent.

3. The method of claim 1, wherein the sheet material is a cellulosic sheet material, the resin is a thermoset resin, said resin being bonded to the sheet material but not thermoset in step (B) but being heated to a thermoset state in step (D).

4. The method of claim 1, wherein the resin is applied to the sheet material with an electrostatic spray apparatus, the resin is heated in step (B) by an infrared heater and the sheet material speed through the spray apparatus and heater is between about 10 to 120 ft/min.

5. The method of claim 3, wherein the sheet material is paper, the thermoset resin comprises an epoxy resin and the wound coil assembly is heated in step (D) between about 100° to 175°C for about 1 minute to 6 hours.

6. The method of claim 3, wherein the conductors are insulated and selected from the group consisting of copper and aluminum, the bonded coil assembly of step (D) is placed in a transformer container and vacuum impregnated in step (E).

7. The method of claim 5, wherein the epoxy resin contains about 10 to 60 wt% of a flexibilizer.

8. The method of claim 5, wherein the paper contains an effective amount of thermal stabilizing agent.

9. A method of making an oil permeable, bonded electrical apparatus comprising the steps of:

A. continuously, uniformly coating both sides of a flexible, porous sheet material having a thickness of between about 1 to 30 mils with dry adhesive resin particles having an average particle size of between about 37 to 420 microns, said coating covering from about 5 to 50 percent of the sheet material area in a non-patterned random distribution;

B. heating the coated sheet material between about 85° to 250°C for an effective period of time, forming a discontinuous 0.25 to 7 mil dry coating of discrete adhesive particles having substantially rounded cross sections bonded to each side of the sheet material, said adhesive coating covering from about 5 to 50 percent of the sheet material area in a non-patterned random distribution, to provide a porous, oil permeable resin particle coated layer insulation;

C. engaging the resin particle coated layer insulation with a conductor;

D. heating the combined conductor and layer insulation at a temperature and for a time effective to securely bond the conductor and layer insulation together, while still providing an adhesive covering of the layer insulation of between about 5 to 50 percent; and E. impregnating the combined conductor and layer insulation with an insulating oil.

10. The method of claim 9 wherein the conductor is an electrical winding of electrical conductor turns.

* * * * *